United States Patent [19]

Isaka

[11] Patent Number: 4,557,173

[45] Date of Patent: Dec. 10, 1985

[54] MUSIC BOX

[75] Inventor: Akihiko Isaka, Nagano, Japan

[73] Assignee: Kabushiki Kaisha Sankyo Seiki Seisakusho, Nagano, Japan

[21] Appl. No.: 671,799

[22] Filed: Nov. 15, 1984

Related U.S. Application Data

[63] Continuation of Ser. No. 451,225, Dec. 20, 1982, abandoned.

[30] Foreign Application Priority Data

Dec. 25, 1981 [JP] Japan ..... 56-195397[U]
Jun. 18, 1982 [JP] Japan ..... 57-104871

[51] Int. Cl.[4] ..... G10F 1/06
[52] U.S. Cl. ..... 84/95 R
[58] Field of Search ..... 84/94 R, 94 C, 95 R, 84/95 C, 96, 92, 98, 99, 100, 101

[56] References Cited

U.S. PATENT DOCUMENTS

| | | | |
|---|---|---|---|
| 3,390,599 | 7/1968 | Komatsu | 84/96 |
| 3,685,382 | 8/1972 | Matthey | 84/95 |
| 4,464,969 | 8/1984 | Isaka et al. | 84/95 R |

*Primary Examiner*—L. T. Hix
*Assistant Examiner*—Brian W. Brown
*Attorney, Agent, or Firm*—Sughrue, Mion, Zinn, Macpeak & Seas

[57] ABSTRACT

A music box includes a spring holder of synthetic resin supported by a frame member. The spring holder is integrally provided with a support member which operates to prevent a tendency for the music box gear train to rise out of position when rotating at high speeds.

4 Claims, 5 Drawing Figures

MUSIC BOX

This is a continuation of application Ser. No. 451,225, filed Dec. 20, 1982, abandoned.

BACKGROUND OF THE INVENTION

The present invention relates to a spring case device for a music box.

It has been customary practice to make spring cases for music boxes by deep-drawing thin sheets of steel. Another known type of spring case is molded of an alloy of zinc by die casting.

The spring case of the music box serves to rotatably hold a first shaft and a drum body and also to secure one end of a spring while preventing the spring from being unwound. Accordingly, the spring case is required to be precisely machined and mechanically strong, and in addition should meet requirements as to appearance, such as color and design.

With the spring cases of deep-drawn thin steel sheets, there are certain limitations as to shape, and those of complicated configurations are difficult to design. Such spring cases have therefore prevented a reduction in the number of parts and the cost of music boxes.

The spring cases fabricated by way of die casting can be molded in complex shapes, but result in an increase in the cost of material used. It is known that the overall weight of a finished music box should be balanced about a vibrator plate. Since, however, the die castings are heavy, the required weight balance is not obtained and the quality of sound generated by the music box is reduced.

The above difficulties can be eliminated by fabricating spring cases of synthetic resin. Spring cases of synthetic resin, however, are disadvantageous in that if they are made thinner for a reduction in size, the mechanical strength thereof becomes smaller.

SUMMARY OF THE INVENTION

The present invention has been made in view of the above shortcoming. It is an object of the present invention to provide a spring case for music boxes which eliminates the problem of reduced mechanical strength.

According to a first aspect of the present invention, there is provided a spring case comprising a spring case body made of synthetic resin and housing a spring, and a frame constituting a portion of the spring case body and supporting the latter fixedly placed thereon, the spring case body having a peripheral wall having a first end face, the frame having a peripheral wall having a second end face, the spring case body and the frame jointly having a window for winding a spring therethrough, the window being defined by confronting recesses formed respectively in the first and second end faces or by a recess formed in either one of the first and second end faces, the spring having an outer end partly engaging the frame.

The spring case of synthetic resin according to the present invention is constructed to compensate for the problem of reduced mechanical strength inherent with the synthetic resin material. With the reduced mechanical strength thus compensated for, the spring case and other components of the music box movement can be integrally formed, resulting in a reduction in the cost of the same.

Where a spring case of synthetic resin is fixed to a frame at a conventional position, the bearings of the gear train and the speed governor mechanism are liable to rise up due to the flexibility of the synthetic resin material as these bearings are located relatively remotely from a fixed portion. In this case, the gear train and the speed governor mechanism are likely to rotate unstably and sometimes become displaced from their positions.

It is another object of the present invention to provide a music box which is free from the above problems.

According to a second aspect of the present invention, there is provided a music box having a spring case including a support supporting an upper portion of a speed governor mechanism, the spring case and the support being integrally molded of synthetic resin, the spring case having portions disposed to retain the shafts of a gear train received in slots in a frame, and another portion fixed to the frame below a vibrator member.

With the music box thus arranged, the spring case is fixed to the frame at a conventional position and at another position to thereby prevent the bearings from rising. Such other position of attachment is disposed in an empty space below the vibrator member, that is, between the vibratable strips and the frame, and hence does not interfere with the space in which other parts are installed. Furthermore, rotative power can be picked up for external use from one of the gears of the gear train. The space below the vibratable strips is large enough for an external output shaft to pass therethrough, and the gear from which rotative power can be picked up is securely journalled by a portion of the spring case and hence can sufficiently serve as a power source. Heretofore, a drum has been employed as the output for supplying rotative power to the exterior. The availability of one of the gears of the gear train as an output shaft for the external power supply results in the increased variety of attachments which can be used with the music box.

By fixing the spring case to the frame at a position near the holders for retaining the gear shaft, the spring case, even if made of synthetic resin, can compensate or reduced mechanical strength. Where the spring case can be fitted onto the frame in the direction in which other parts are fitted into the frame, the spring case can be automatically assembled with ease by simply being dropped in place onto the frame.

Furthermore, an interconnection between staking portions on the frame and the seat for the vibrator plate by means of ribs with a portion of the spring case fixed to the frame below the vibratable strips increases the rigidity of the seat of the frame and improves the quality of sound generated by the music box. The conventional rib contiguous to the vibrator plate seat has been provided only between the drum bearing and the seat. With the present invention, however, the ribs extend from the seat in opposite directions, and the sound quality is improved.

With provision made for reliably preventing the gears from rising, the spring case can be made of synthetic resin, and its governor brake and gear holder arms can be integrally molded. Therefore, the music box can be fabricated of a greatly reduced number of parts and at less cost.

DETAILED DESCRIPTION OF THE PREFERRED EMBODIMENTS

Figure 1:
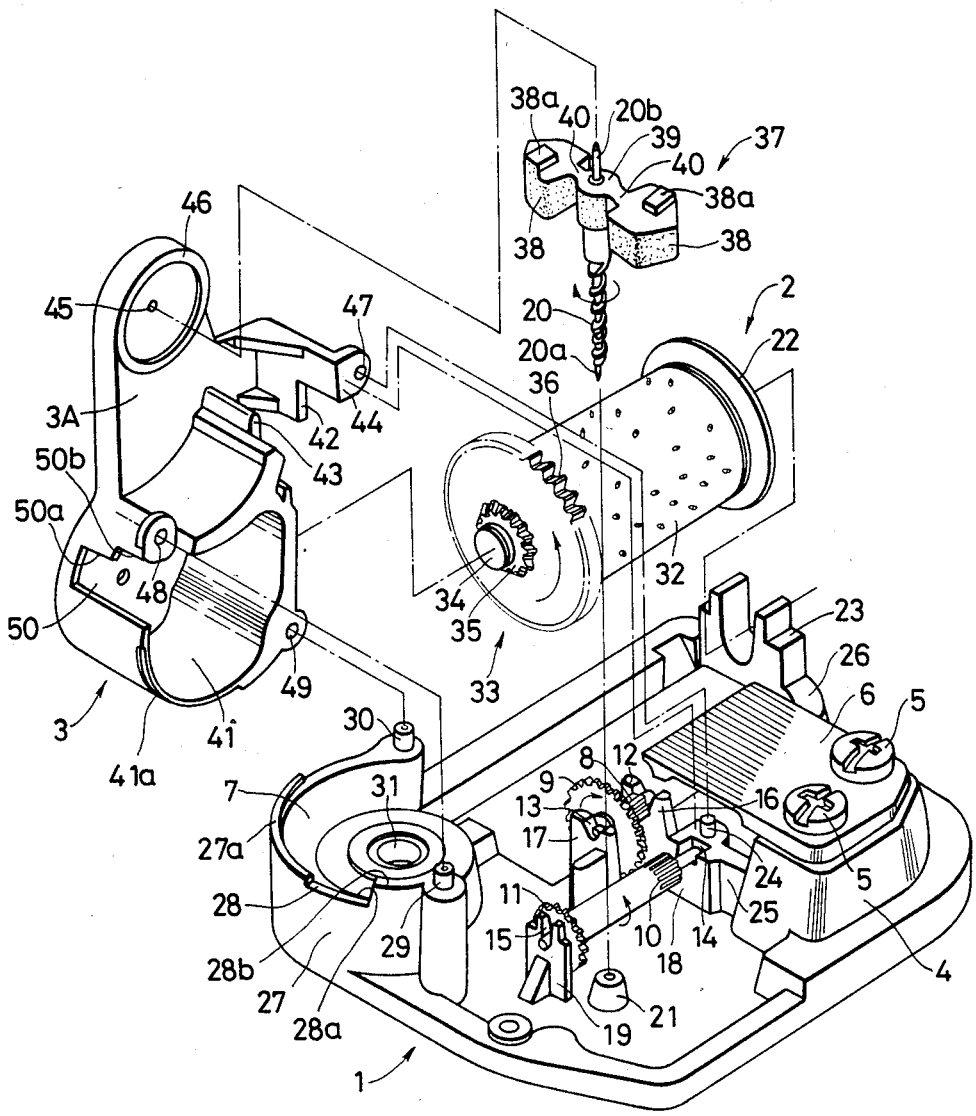
FIG. 1 is an exploded perspective view of a music box according to one embodiment of the present invention.

FIG. 1 shows in a exploded perspective view a movement including a frame 1, a drum 2, and a spring case 3. The frame 1 has a seat 4 to which there is secured by means of screws 5, 5 a vibrator member 6 comprising a single vibrator plate. This vibrator member 6 may be of the type composed of a multiplicity of parallel vibratable strips having different frequencies of vibration.

The frame 1 has a cavity 7 defining a bottom of the spring case 3, a plurality of projections 16, 17, 18, 19 in which there are defined bearing slots 12, 13, 14, 15, respectively, supporting gears 8, 9, 10, 11, respectively, which serve as a gear train for transmitting drive power from a spring 60 to a speed governor mechanism (described later), a bearing 21 supporting a lower end 20*a* of a worm shaft 20 of the speed governor mechanism, and a bearing 23 by which there is rotatably supported a shaft (which is not shown and may be hollow) on one end plate 22 of the drum 2. The projection 18 has an upwardly extending staking boss 24. The seat 4 is continuous with the projection 18 and a staking portion 23*a* (FIG. 2) of the bearing 23 through ribs 25, 26, respectively. The cavity 7 is defined by a partial peripheral wall 27 having a recess 28 and upwardly extending staking bosses 29, 30. The cavity 7 has a central hole 31 through which a spring windup shaft 53 extends.

The drum 2 comprises a cylindrical body 32 having needles for engaging the vibrator strips, and end plates 22, 33 fixedly fitted over the ends of the cylindrical body 32. The end plate 33 has a shaft 34 on the axis of rotation of the drum 2, a bevel gear 35 meshing with a bevel gear 55 of a ratchet mechanism 54 in the spring case 3, and teeth 36 meshing with the gear 8, the end plate 33 being integrally molded by synthetic resin.

The gears 8, 9 are integral with each other, the gear 9 being in mesh with the gear 10. The gears 10, 11 are integral with each other, the gear 11 serving as a worm wheel held in mesh with the worm shaft 20.

The worm shaft 20 constitutes a portion of the speed governor mechanism. A rotatable body 37 which is made of rubber or a rubber-like material is force-fitted over the worm shaft 20. The rotatable body 37 is composed of weights 38, 38, a boss 39, and elastically deformable arms 40, 40 interconnecting the boss 39 and the weights 38, 38. The weights 38, 38 have protrusions 38*a*, 38*a* on their upper surfaces for displacing the centers of gravity of weights 38, 38 when the rotatable body 37 rotates. The worm shaft 20 has a pointed upper end 20*b*.

The spring case 3 includes a spring container 41 housing the spring 60 (FIGS. 2 through 4) and the ratchet mechanism 54. Shaft holders 42, 43, 44 engage the projections 16, 17, 18, respectively, for retaining the shafts against removal, and a bearing hole 45 supports the upper end 20*b* of the worm shaft 20. An annular brake 46 extends around the bearing hole 45 and along the path of rotation of the protrusions 38*a*, 38*a*. The spring case further includes holes in attachment portions 47, 48, 49 in which the staking bosses 24, 29, 30 are fitted, respectively, and a recess 50 defined by a peripheral wall of the spring container 41 and cooperating with the recess 28 in locking ends or ears 60*b*, 60*c* of the spring 60. The peripheral wall of the spring container 41 has on its outer face a bearing 41*b* supporting the shaft 34 of the drum 2.

The spring case 3 not only serves to house the spring 60, but includes an integral support 3A that supports the upper end of the speed governor mechanism and serves as part of the gear bearing.

The drum 2 can be rotatably attached in place by supporting the end plate 22 on the bearing 23, staking the staking portion 23*a* on the bearing 23 to retain the end plate 22, and supporting the shaft 34 on the bearing 41*b* of the spring case 3. The gears are respectively received by the bearing slots therefor. The worm shaft 20 is received by the bearing 21. At this time, the vibrating member 6 remains unattached. Then, the spring case 3 is positioned with the attachment portions 47, 48, 49 fitted respectively over the staking bosses 24, 29, 30. The shaft holders 42, 43 cooperate with the bearing slots 12, 13, respectively, in rotatably supporting the gears 8, 9. The bearing holder 44 and the bearing slot 14 jointly support the gear 10. The bearing slot 15 is staked prior to attachment of the spring case 3.

Thereafter, the staking bosses 24, 29, 30 are staked to attach the spring case 3 securely to the frame 1. The vibrator member 6 is finally affixed in position to thereby complete the movement for a music box of the standard type.

The peripheral wall 27 of the frame 1 has an end held in abutment against an end of the spring case 3 with stepped portions 27*a*, 41*a* engaging each other to reinforce the assembled parts.

Figure 2:
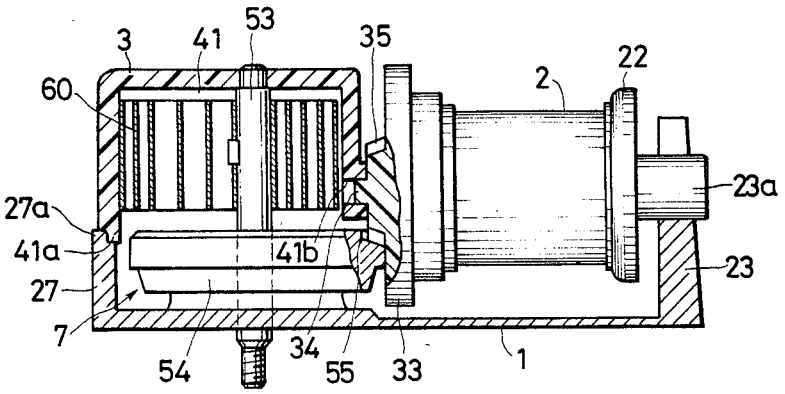
FIG. 2 is a cross-sectional view of a movement as assembled.
Figure 3:
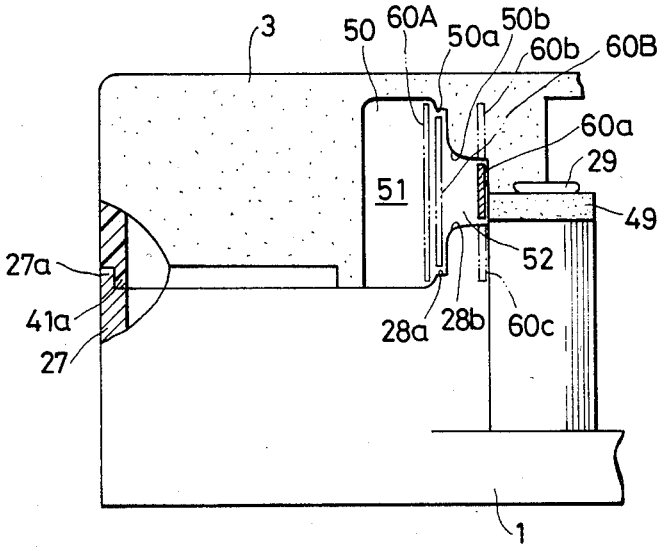
FIG. 3 is a fragmentary front elevational view of the portion of the movement.
Figure 4:
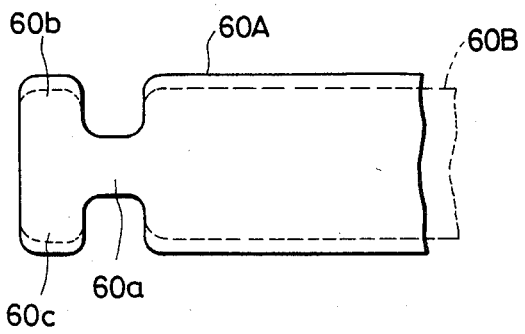
FIG. 4 is a fragmentary front elevational view of the locking end of a spring.

As shown in FIGS. 2 and 3, a distal end of the spring 60 is brought into locking engagement with the shaft 53 through a window 51, and then the spring 60 is wound in. Where the spring 60 is of the wide type 60A, it can be wound in through a wide portion of the window 51. Where the spring is of the ordinary type 60B, it can be wound in through a guide portion defined by stepped portions 28*a*, 50*a*. Whatever type the spring 60 may be, a narrow locking portion 60*a* of the spring 60 is engaged by a locking portion 52 constituted of stepped portions 28*b*, 50*b*. The end of the spring 60 is locked in position when the ear 60*b* is held against the peripheral wall of the spring container 41 and the ear 60*c* is held against the peripheral wall 27.

Accordingly, when the spring is wound up, its ears 60*a*, 60*c* are locked by not only the peripheral wall of synthetic resin, but also by the peripheral wall 27 of metal, and hence the spring can be reliably housed and locked in place without deforming the member of synthetic resin. Since the attachment portion 48 for combining the spring case 3 and the frame 1 securely together is located adjacent to the locking portion 52, the window 51 is reinforced in mechanical strength.

With the arrangement of the present invention, the window through which the spring can be wound in is defined by both the spring case and the frame which are assembly securely together. Although in the embodiment shown in FIG. 3 the recess defining such window is formed in both the spring case and the frame, the recess may be defined in either of them along. In such an alternative, however, the window for winding in the spring is still defined by both the spring case and the frame.

When a stop (not shown) is released from its engagement with the weights 38 after the spring 60 has been wound, the torque of the spring 60 is applied to rotate the bevel gears 35, 36 in the direction of the arrow (FIG. 1). The rotation of the bevel gear 36 is transmitted through the gears 8, 9, 10, 11 at an increased speed to the worm shaft 20 to rotate the rotatable body 37 at a higher speed. As the rotatable body 37 rotates at a high speed, the weights 38, 38 are allowed by their arms 40, 40 to flex upwardly until their upper surfaces are brought into contact with an annular end face of the brake 46, whereupon the rotatable body 37 is braked. Stated otherwise, the gear train which is rotated under the torque of the spring 60 is controlled to rotate at a constant speed, to thereby rotate the drum 2 at a predetermined speed for vibrating the vibratable strips.

While the music box is being played, that is, the gear train is being rotated, the worm shaft 20 is subjected to a force which tends to lift the same, and the gears 8, 9 also undergo an upward force.

Also, the shafts of the gears 8 and 9 are subjected to upwardly directed forces by which forces are applied to the support 3A to be deformed. As a result, the resin forming the support 3A cannot stand the applied forces, resulting in undue deformation which will cause noises and damages.

According to the present invention, the support 3A which supports the upper end of the speed governor mechanism is affixed to the frame 1 by the staking boss 24 and the attachment portion 47, with the result that the synthetic resin support 3A and hence the spring container will not be deformed even under such force. With the space below the vibrator member 6 being utilized, the space for installation of the other parts is not limited or reduced at all.

Figure 5:
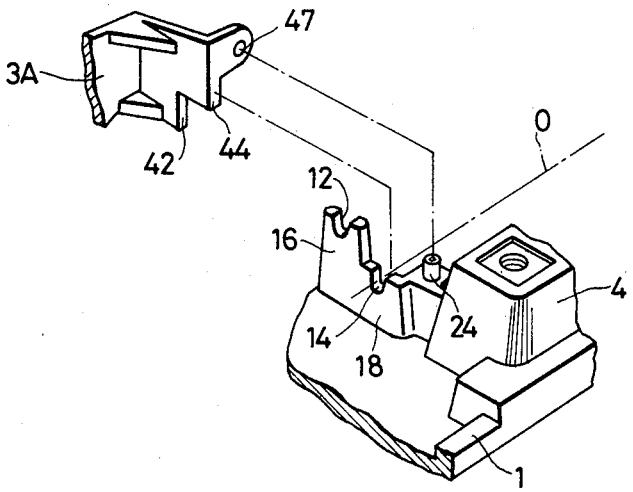
FIG. 5 is a fragmentary exploded perspective view of a frame and support attached to each other at a different position.

FIG. 5 shows an arrangement in which an external output shaft can be attached. With such an arrangement, staking boss 24 is retracted from an axis O of rotation of the gear 10. A hole in an attachment portion 47 is disposed in alignment with the staking boss 24, and a shaft holder 44 faces the bearing slot 14 from above. By thus positioning support 3A with respect to a frame 1 and by elongating the shaft of the gear 10, an external output shaft (not shown) can be coupled to the shaft of the gear 10. There should be a space between the vibrator member and the frame, which is large enough for the external output shaft to pass therethrough. Such an external output shaft has conventionally been connected to the drum. According to the present invention, however, the external output shaft can be coupled to the gear 10 which is securely rotatably supported by the staking boss 24 and the attachment portion 47 which are attached to one another. Since the shafts are prevented from rising, an empty space below the vibrator plate can be utilized to pick up rotative power from the gear 8.

What is claimed is:

1. A spring case, comprising; a spring case body made of synthetic resin and housing a spring, and a metallc frame constituting a portion of said spring case and supporting the spring case body thereon, said spring case having a peripheral wall having a first end face, said frame having a peripheral wall having a second end face, said spring case body and said frame jointly having a window for inserting a spring therethrough, said window having a narrow portion for retaining an end of said spring and a wider portion for admitting said spring, said window being defined by confronting recesses formed respectively in at least one of said first and second end faces, said spring having an outer end adapted to be held at said narrow portion and partly engaging said metallic frame.

2. A spring case as claimed in claim 1, wherein said spring case body and said frame are each provided with integral flange portions, the respective flange portions of said spring case body and said frame being interlockingly engaged when said spring case body is placed on said frame.

3. A spring case as claimed in claim 1, further including means for fixedly coupling said spring case to said frame at at least one position proximate said window.

4. A spring case as claimed in claim 1, wherein said spring case body includes rotor support means formed integrally therewith, said rotor support means being formed of said synthetic resin.

* * * * *